US007682225B2

(12) United States Patent
Hongo et al.

(10) Patent No.: US 7,682,225 B2
(45) Date of Patent: Mar. 23, 2010

(54) POLISHING APPARATUS AND SUBSTRATE PROCESSING APPARATUS

(75) Inventors: Akihisa Hongo, Tokyo (JP); Kenya Ito, Tokyo (JP); Kenji Yamaguchi, Tokyo (JP); Masayuki Nakanishi, Tokyo (JP)

(73) Assignee: Ebara Corporation, Tokyo (JP)

( * ) Notice: Subject to any disclaimer, the term of this patent is extended or adjusted under 35 U.S.C. 154(b) by 961 days.

(21) Appl. No.: 10/581,669

(22) PCT Filed: Feb. 23, 2005

(86) PCT No.: PCT/JP2005/003415

§ 371 (c)(1),
(2), (4) Date: Jun. 5, 2006

(87) PCT Pub. No.: WO2005/081301

PCT Pub. Date: Sep. 1, 2005

(65) Prior Publication Data

US 2009/0117828 A1 May 7, 2009

(30) Foreign Application Priority Data

Feb. 25, 2004 (JP) ..... 2004-049236

(51) Int. Cl.
*B24B 24/00* (2006.01)

(52) U.S. Cl. ..... 451/303; 451/304; 451/307; 451/446; 451/168

(58) Field of Classification Search ..... 451/43, 451/44, 296, 303, 304, 306, 307, 446, 168
See application file for complete search history.

(56) References Cited

U.S. PATENT DOCUMENTS 5,509,850 A 4/1996 Morioka et al.
5,655,954 A * 8/1997 Oishi et al. ..... 451/67
5,733,181 A * 3/1998 Hasegawa et al. ..... 451/168
5,885,138 A 3/1999 Okumura et al.
6,402,596 B1 * 6/2002 Hakomori et al. ..... 451/44
6,500,051 B1 * 12/2002 Nishi et al. ..... 451/41
6,558,239 B2 * 5/2003 Kunisawa et al. ..... 451/303
7,014,529 B1 * 3/2006 Kubota et al. ..... 451/7

(Continued)

FOREIGN PATENT DOCUMENTS

JP 5-329759 12/1993

(Continued)

*Primary Examiner*—Elleen P. Morgan
(74) *Attorney, Agent, or Firm*—Wenderoth, Lind & Ponack L.L.P.

(57) ABSTRACT

The present invention relates to a polishing apparatus for removing surface roughness produced at a peripheral portion of a substrate, or for removing a film formed on a peripheral portion of a substrate. The polishing apparatus includes a housing for forming a polishing chamber therein, a rotational table for holding and rotating a substrate, a polishing tape supply mechanism for supplying a polishing tape into the polishing chamber and taking up the polishing tape which has been supplied to the polishing chamber, a polishing head for pressing the polishing tape against a bevel portion of the substrate, a liquid supply for supplying a liquid to a front surface and a rear surface of the substrate, and a regulation mechanism for making an internal pressure of the polishing chamber being set to be lower than an external pressure of the polishing chamber.

5 Claims, 11 Drawing Sheets

U.S. PATENT DOCUMENTS

| | | | | |
|---|---|---|---|---|
| 7,367,873 | B2 * | 5/2008 | Ishii et al. | 451/168 |
| 7,386,944 | B2 * | 6/2008 | Yi et al. | 34/527 |
| 2001/0011002 | A1 * | 8/2001 | Steere, III | 451/168 |
| 2002/0098787 | A1 * | 7/2002 | Kunisawa et al. | 451/307 |
| 2003/0040261 | A1 * | 2/2003 | Nishi et al. | 451/8 |
| 2003/0139049 | A1 | 7/2003 | Nakamura et al. | |
| 2004/0106363 | A1 | 6/2004 | Ishii et al. | |
| 2004/0185751 | A1 * | 9/2004 | Nakanishi et al. | 451/5 |
| 2004/0198052 | A1 * | 10/2004 | Togawa et al. | 438/689 |
| 2006/0084369 | A1 * | 4/2006 | Nishi et al. | 451/57 |

FOREIGN PATENT DOCUMENTS

| | | |
|---|---|---|
| JP | 7-124853 | 5/1995 |
| JP | 7-164301 | 6/1995 |
| JP | 8-243916 | 9/1996 |
| JP | 2000-218497 | 8/2000 |
| JP | 2001-205549 | 7/2001 |
| JP | 2002-208572 | 7/2002 |
| JP | 2003-163188 | 6/2003 |
| JP | 2003-234314 | 8/2003 |
| JP | 2004-241434 | 8/2004 |

* cited by examiner

POLISHING APPARATUS AND SUBSTRATE PROCESSING APPARATUS

BACKGROUND OF THE INVENTION

I. Technical Field

The present invention relates to a polishing apparatus and a substrate processing apparatus, and more particularly to a polishing apparatus for removing surface roughness produced at a peripheral portion (a bevel portion and an edge portion) of a substrate such as a semiconductor wafer, or for removing a film formed on a peripheral portion of a substrate, and to a substrate processing apparatus having such a polishing apparatus.

II. Description of the Related Art

In recent years, according to finer structures and higher integration of semiconductor devices, it has become more important to manage particles. One of the major problems in managing particles is dust caused by surface roughness produced at a bevel portion and an edge portion of a semiconductor wafer (substrate) in a fabrication process of semiconductor devices. In this case, a bevel portion means, as shown in FIG. 11, a portion B having a curvature in a cross-section of an edge of a semiconductor wafer W, and an edge portion means a flat portion E extending about several millimeters radially inwardly from the bevel portion B of the wafer. Hereinafter, the bevel portion and the edge portion will be collectively referred to as a peripheral portion.

In the fabrication process of the semiconductor devices, a large number of needle-like fine projections may be formed on the peripheral portion of the semiconductor wafer, thereby producing the surface roughness. The needle-like projections may be broken in transferring or processing the semiconductor wafer and thus produce the particles. Since such particles lead to a lower yield, it is necessary to remove the needle-like projections formed on the peripheral portion of the semiconductor wafer.

There has recently been a tendency to use Cu as interconnect material of the semiconductor devices and to use low-k material as dielectric. If Cu formed on the peripheral portion of the semiconductor wafer is attached to an arm of a transfer robot or a cassette in which the semiconductor wafer is accommodated, Cu may be diffused to contaminate other processes, resulting in a so-called cross contamination. Since low-k film has a very low strength, it may be detached from the peripheral portion of the semiconductor wafer during CMP process and may damage, e.g. scratch, a patterned surface. Therefore, it is important to completely remove Cu and low-k film from the peripheral portion of the semiconductor wafer.

From such situations, in the semiconductor fabrication process, the polishing of the peripheral portion of the substrate is carried out using a polishing tape having fixed abrasive attached on a surface thereof In this kind of polishing process, the polishing tape is brought into sliding contact with the peripheral portion of the substrate while the substrate is being rotated, thereby removing the needle-like projections and the film formed on the peripheral portion of the substrate. However, when the polishing tape is in sliding contact with the peripheral portion of the substrate, polishing wastes (shavings) are scattered around the substrate. If such polishing wastes are attached to the device part of the substrate, defects may be caused in this device part, resulting in a low yield. Therefore, it is necessary to prevent the polishing wastes from attaching to the substrate. Further, also in a cleaning process, a drying process, and a substrate-transferring process after the polishing process, it is necessary to prevent the polishing wastes and particles, which have been produced in the polishing process, from attaching to the substrate.

SUMMARY OF THE INVENTION

The present invention has been made in view of the above drawbacks. It is an object of the present invention to provide a polishing apparatus capable of preventing the polishing wastes and the particles produced in the polishing process from attaching to the surface of the substrate during the polishing process and the subsequent processes such as the transferring of the substrate, and to provide a substrate processing apparatus having such a polishing apparatus.

In order to achieve the above object, according to one aspect of the present invention, there is provided a polishing apparatus comprising: a housing for forming a polishing chamber therein; a rotational table for holding and rotating a substrate, the rotational table being disposed inside the polishing chamber; a polishing tape supply mechanism for supplying a polishing tape to the polishing chamber and taking up the polishing tape which has been supplied to the polishing chamber; a polishing head for pressing the polishing tape against a bevel portion of the substrate; a liquid supply for supplying a liquid to a front surface and a rear surface of the substrate; and a regulation mechanism for making an internal pressure of the polishing chamber being set to be lower than an external pressure of the polishing chamber; wherein the polishing tape supply mechanism is disposed outside the polishing chamber.

According to the present invention, since the liquid is supplied to the front and rear surfaces of the substrate during the polishing, the polishing wastes and particles are prevented from attaching to the device part of the substrate. Further, since the internal pressure of the polishing chamber can be lower than the external pressure of the polishing chamber by the evacuation of the polishing chamber through the gas outlet passage, it is possible to prevent the polishing wastes from being scattered around the polishing chamber and thus to prevent the polishing wastes from entering a region where a high cleanliness is required. Furthermore, since the polishing tape supply mechanism is disposed outside the polishing chamber, the polishing chamber can be small and can easily be kept clean.

In a preferred aspect of the present invention, the polishing apparatus further comprises an oscillation mechanism for vertically swinging the polishing head about the bevel portion of the substrate, wherein the oscillation mechanism is disposed outside the polishing chamber.

In a preferred aspect of the present invention, the polishing apparatus further comprises a relative movement mechanism for moving the polishing head and the substrate relative to each other in a tangential direction of the substrate, wherein the relative movement mechanism is disposed outside the polishing chamber.

In a preferred aspect of the present invention, the polishing apparatus further comprises an oscillation mechanism for vertically swinging the polishing head about the bevel portion of the substrate; and a relative movement mechanism for moving the polishing head and the substrate relative to each other in a tangential direction of the substrate; wherein the oscillation mechanism and the relative movement mechanism are disposed outside the polishing chamber.

According to the present invention, it is possible to polish not only the bevel portion but also the edge portion of the substrate. Therefore, the polishing rate (removal rate) can be improved.

In a preferred aspect of the present invention, the liquid supply comprises a first nozzle for supplying a liquid to a portion of contact between the polishing tape and the substrate, a second nozzle for supplying a liquid to the substrate so as to form a liquid film over the front surface of the substrate, and a third nozzle for supplying a liquid to the rear surface of the substrate.

According to this structure, the portion, which is being polished, of the substrate can be cooled and the removal of the polishing wastes can be accelerated. Further, it is possible to prevent the polishing wastes from attaching to the front and rear surfaces of the substrate.

In a preferred aspect of the present invention, the polishing apparatus further comprises a positioning mechanism for centering the substrate on the rotational table, wherein the positioning mechanism comprises a pair of arms which are movable in parallel with each other, and an arm drive mechanism for moving the arms closer to and away from each other, and each of the arms has at least two contact members which are brought into contact with the bevel portion of the substrate.

In a preferred aspect of the present invention, the polishing apparatus further comprises an end point detector for detecting a polishing end point.

In a preferred aspect of the present invention, the end point detector comprises an image sensor for taking an image of a polished portion of the substrate, and a controller for determining a condition of the polished portion by analyzing the image obtained by the image sensor.

In a preferred aspect of the present invention, the polishing head comprises an ultrasonic vibrator.

With this structure, the polishing wastes can be prevented from attaching to the polishing tape, and the polishing process can be accelerated.

In a preferred aspect of the present invention, the polishing apparatus further comprises a pure water ejector for ejecting pure water into the polishing chamber so as to clean the polishing chamber.

With this structure, the polishing wastes and particles attached to an inner surface of the housing, the rotational table, the polishing head, and other equipment can be washed out by the pure water, and hence the polishing chamber can be kept clean.

According to another aspect of the present invention, a substrate processing apparatus comprising: a polishing unit for polishing a bevel portion of a substrate by bringing a polishing tape into sliding contact with the bevel portion of the substrate; a cleaning unit for cleaning at least the bevel portion of the substrate; and a drying unit for drying the substrate which has been cleaned by the cleaning unit.

In a preferred aspect of the present invention, the polishing unit brings the polishing tape into sliding contact with the bevel portion and an edge portion of the substrate so as to polish the bevel portion and the edge portion.

In a preferred aspect of the present invention, the polishing unit brings a polishing tape into sliding contact with a notch portion of the substrate so as to polish the notch portion.

In a preferred aspect of the present invention, the substrate processing apparatus further comprises a partition which divides an internal space of the substrate processing apparatus into a polishing area for polishing the substrate and a cleaning area for cleaning the substrate, an internal pressure of the polishing area being set to be lower than an internal pressure of the cleaning area.

In a preferred aspect of the present invention, the substrate processing apparatus further comprises a fan unit for forming a downward current of a clean gas in the cleaning area.

In a preferred aspect of the present invention, the substrate processing apparatus further comprises a chemical mechanical polishing unit for polishing a surface of the substrate by pressing the substrate against a polishing table.

DETAILED DESCRIPTION OF THE INVENTION

A polishing apparatus according to an embodiment of the present invention will be described below with reference to the drawings. The polishing apparatus of the present invention is designed for the purpose of polishing a bevel portion and an edge portion, i.e., a peripheral portion, of a substrate such as a semiconductor for removing surface roughness and unwanted films formed on the peripheral portion of the substrate.

Figure 1:
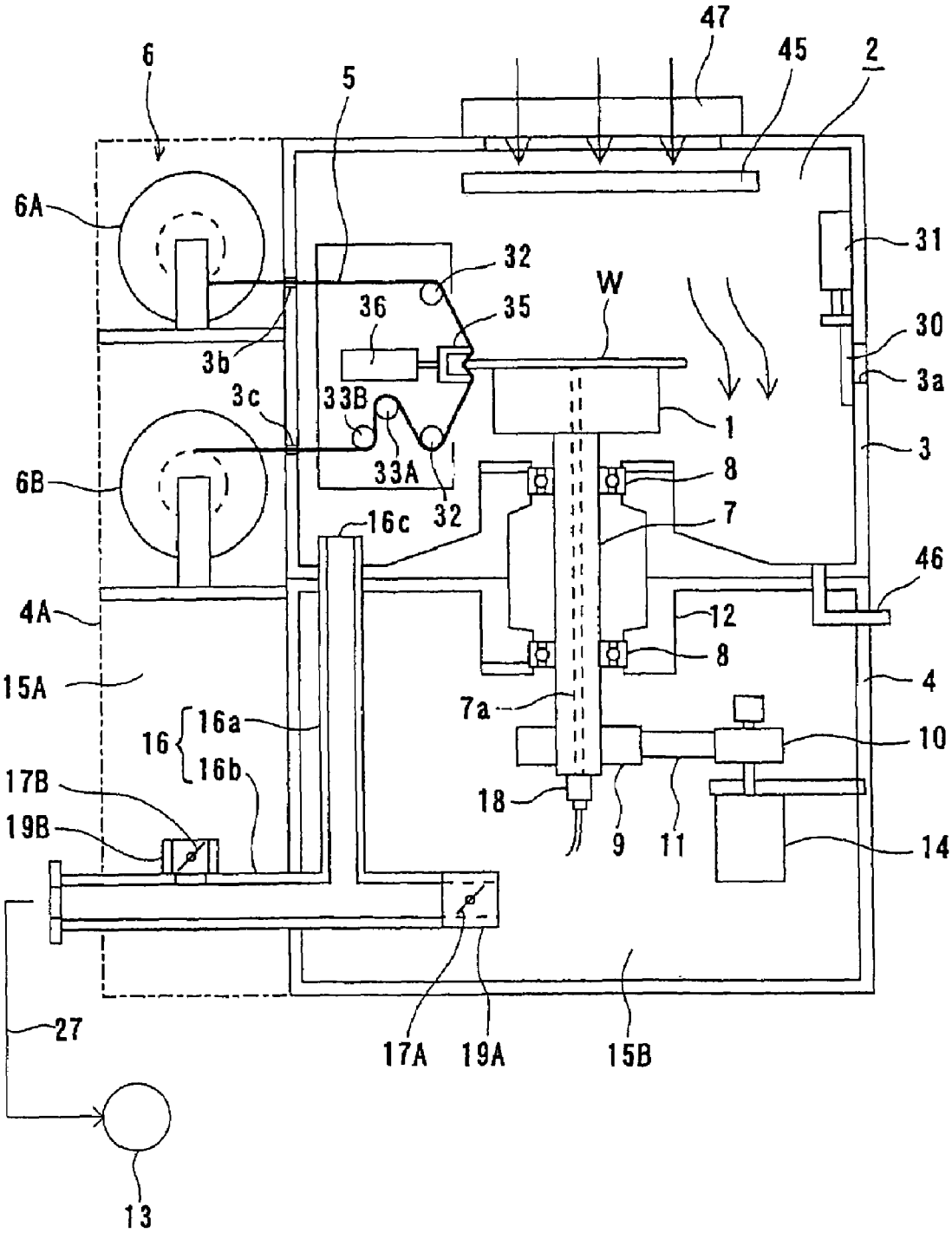
FIG. 1 is a vertical cross-sectional view showing a polishing apparatus according to an embodiment of the present invention.
Figure 2:
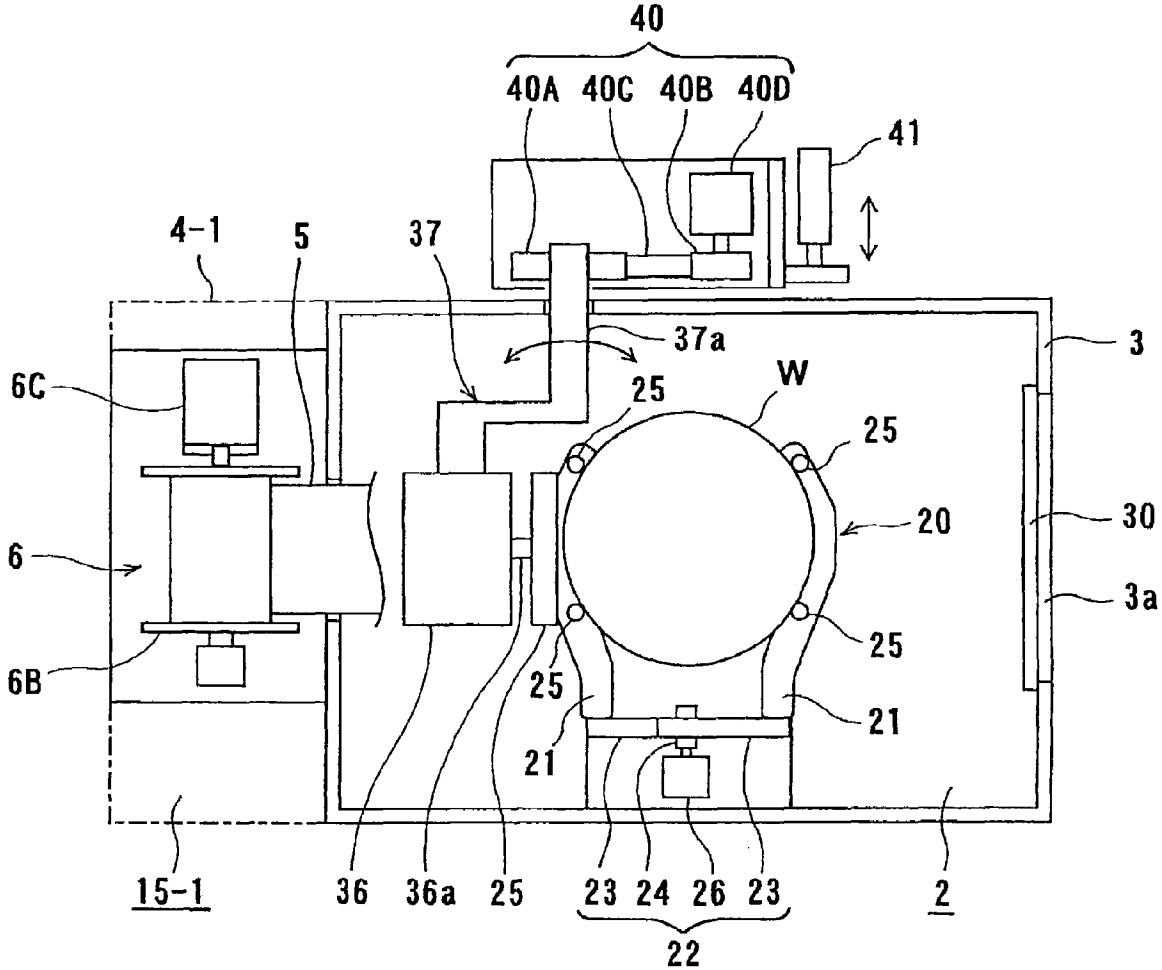
FIG. 2 is a transverse cross-sectional view of the polishing apparatus shown in FIG. 1.

FIG. 1 is a vertical cross-sectional view showing the polishing apparatus according to the embodiment of the present invention, and FIG. 2 is a transverse cross-sectional view of the polishing apparatus shown in FIG. 1.

As shown in FIGS. 1 and 2, the polishing apparatus comprises a rotational table 1 for holding and rotating a semiconductor wafer W, an upper housing 3 having a polishing chamber 2 formed therein, a lower housing 4 disposed below the upper housing 3, a side housing 4A provided next to the upper housing 3 and the lower housing 4, and a polishing tape supply mechanism 6 for supplying a polishing tape 5 to the polishing chamber 2 and taking up the polishing tape 5 which has been supplied to the polishing chamber 2. A first equipment room 15A is formed in the side housing 4A, and the polishing tape supply mechanism 6 is disposed in this first equipment room 15A. The polishing chamber 2 is defined by the upper housing 3, and the rotational table 1 is disposed in the polishing chamber 2. The polishing chamber 2 may be a hermetic chamber having only an upper opening. A rotational drive shaft 7 is coupled to a lower portion of the rotational table 1 and rotatably supported by bearings 8, 8 fixed to an inner circumferential surface of a cylindrical support member 12. The rotational drive shaft 7 has a pulley 9 fixed to the lower end portion thereof This pulley 9 is coupled to a pulley 10 by a belt 11 and the pulley 10 is coupled to a motor 14. With this arrangement, the rotational drive shaft 7 is rotated by the motor 14 through the pulleys 9, 10 and the belt 11, thereby rotating the rotational table 1. The rotating mechanism including the pulleys 9, 10, the belt 11, and the motor 14 is disposed in a second equipment room 15B defined in the lower housing 4. The polishing tape supply mechanism 6 may be disposed in the second equipment room 15B.

The polishing chamber 2, the first equipment room 15A, and the second equipment room 15B communicate with a vacuum source (e.g., a vacuum pump) 13 through a gas outlet pipe (a regulation mechanism) 16. This gas outlet pipe 16 comprises a vertical pipe 16*a* having an open end 16*c* located in the polishing chamber 2, and a horizontal pipe 16*b* having an open end 19A located in the second equipment room 15B. The vertical pipe 16*a* and the horizontal pipe 16*b* communicate with each other. The open end 19A of the horizontal pipe 16*b* is provided with a discharge damper 17A which opens and closes the open end 19A. The horizontal pipe 16*b* has an opening portion 19B which is located in the first equipment room 15A. A discharge damper 17B is provided in the opening portion 19B, so that the opening portion 19B is opened and closed by the operation of the discharge damper 17B. The other open end of the horizontal pipe 16*b* is connected to the vacuum source 13 through a pipe 27.

A filter 47 is provided on an upper portion of the polishing chamber 2, so that an air passes through the filter 47 to form a clean air current in the polishing chamber 2. The clean air current flows downwardly near the peripheral portion of the semiconductor wafer W, and is then sucked from the suction mouth (open end) 16*c* of the gas outlet pipe 16 to the exterior. Such air current can prevent the contamination of the semiconductor wafer W which is being polished and equipment such as arms 21 of a positioning mechanism shown in FIG. 2, which will be described later.

A through-hole 7*a* is formed so as to extend through the rotational table 1 and the rotational drive shaft 7, and an upper open end of the through-hole 7*a* is located at an upper surface of the rotational table 1. A lower open end of the through-hole 7*a* is connected to a non-illustrated vacuum source through a rotary connector 18 provided on the lower end portion of the rotational drive shaft 7. The vacuum source produces a vacuum in the through-hole 7*a*, and the semiconductor wafer W is thus attracted to the upper surface of the rotational table 1. In this manner, the rotational table 1 can rotate the semiconductor wafer W while holding the semiconductor wafer W.

The positioning mechanism 20 for centering the semiconductor wafer W on the rotational table 1 is provided in the polishing chamber 2. The positioning mechanism 20 comprises a pair of arms 21 which are movable horizontally in parallel with each other, and an arm drive mechanism 22 for moving these arms 21 closer to and away from each other. The arm drive mechanism 22 comprises racks 23 fixed respectively to the arms 21, a pinion 24 meshing with these racks 23, and a motor 26 for rotating the pinion 24. Each of the arms 21 has two contact members 25 which are brought into contact with the bevel portion of the semiconductor wafer W. These contact members 25 are positioned in the same horizontal plane as the semiconductor wafer W on the rotational table 1. While the semiconductor wafer W is being polished, the positioning mechanism 20 is moved downwardly by a non-illustrated movement mechanism. Although two contact members 25 are provided on each of the arms 21 in this embodiment, three or more contact members may be provided. The centering of the semiconductor wafer W is important in view of keeping a uniform polishing region of the bevel portion over the entire circumference of the semiconductor wafer W.

On a side surface of the upper housing 3, there are provided an entrance aperture 3*a* through which the semiconductor wafer W is transferred into the polishing chamber 2, a shutter 30 for covering the entrance aperture 3*a*, and an air cylinder 31 for moving the shutter 30 up and down. The semiconductor wafer W to be polished is transferred into the polishing chamber 2 through the entrance aperture 3*a* by a non-illustrated transfer robot until the semiconductor wafer W is positioned above the rotational table 1. In this state, the arms 21 are moved closer to each other to bring the contact members 25 of the arms 21 into contact with the bevel portion of the semiconductor wafer W, thereby centering the semiconductor wafer W on the rotational table 1.

The polishing tape supply mechanism 6 is installed on the sidewall of the upper housing 3 and disposed in the first equipment room 15A located outside the polishing chamber 2. The polishing tape supply mechanism 6 comprises a supply reel 6A for supplying the polishing tape 5 into the polishing chamber 2, a take-up reel 6B for taking up the polishing tape 5 which has been supplied to the polishing chamber 2, and a motor 6C for rotating the take-up reel 6B. The sidewall of the upper housing 3 has two slits 3*b*, 3*c* through which the polishing tape 5 passes. These slits 3*b*, 3*c* are located near the supply reel 6A and the take-up reel 6B, respectively. The polishing tape 5 from the supply reel 6A passes through the upper slit 3*b* into the polishing chamber 2, and the polishing tape 5 from the polishing chamber 2 passes through the lower slit 3*c* and is taken up by the take-up reel 6B.

The polishing tape 5 may comprise a tape having abrasive particles of diamond or SiC bonded on its one side surface serving as a polishing surface. The abrasive particles to be bonded to the polishing tape are selected according to type of the semiconductor wafer W or a required performance. For example, diamond having a grain size of # 4000 to #11000 or SiC having a grain size of # 4000 to #10000 may be used. A tape-like polishing cloth having no abrasive particle may also be used.

Inside the polishing chamber 2, there are disposed two main guide rollers 32 and two auxiliary guide rollers 33A, 33B for guiding the polishing tape 5. These main guide rollers 32 extend in parallel with the upper surface of the rotational table 1 and are disposed in parallel with each other. Further, these main guide rollers 32 are arranged vertically (i.e., along a direction of the rotational axis of the rotational table 1) in such a position that the semiconductor wafer W is located at a midpoint between the two main guide rollers 32. With such an arrangement, the polishing tape 5 guided by the main guide rollers 32 moves vertically near the bevel portion of the semiconductor wafer W. The auxiliary guide rollers 33A, 33B are disposed downwardly of the main guide rollers 32 with respect to a moving direction of the polishing tape 5. The auxiliary guide roller 33A is loaded upwardly by a non-illustrated spring, and the auxiliary guide roller 33B is fixed in position.

Figure 3A:
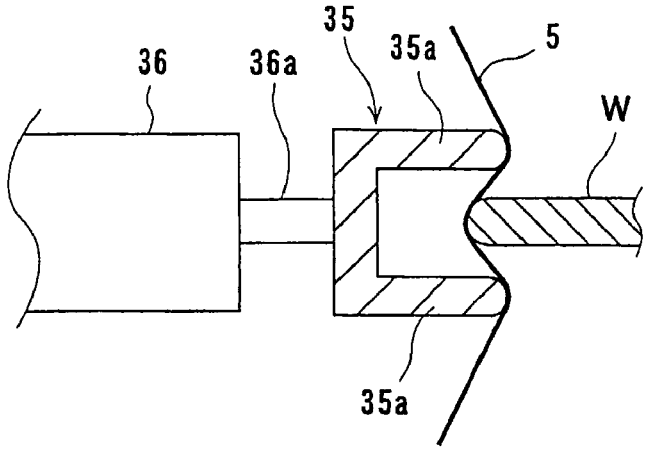
FIG. 3A is an enlarged cross-sectional view showing a polishing head shown in FIG. 1.

In the polishing chamber 2, there are also provided a polishing head 35, and a pusher cylinder 36 for moving the polishing head 35 toward the semiconductor wafer W. FIG. 3A is an enlarged cross-sectional view showing the polishing head shown in FIG. 1. As shown in FIG. 3A, the polishing head 35 has two projecting portions 35*a* projecting toward the semiconductor wafer W. These projecting portions 35*a* are arranged vertically and disposed such that the bevel portion of the semiconductor wafer W is positioned between the projecting portions 35*a*. The polishing head 35 is fixed to a rod 36*a* of the pusher cylinder 36 and disposed so as to face a rear surface (i.e., a surface at an opposite side of the polishing surface) of the polishing tape 5. With this structure, when the polishing head 35 is moved by the pusher cylinder 36 toward the semiconductor wafer W, the polishing surface of the polishing tape 5 is pressed against the bevel portion of the semiconductor wafer W by the polishing head 35. At this time, the polishing tape 5 is deformed so as to fit the bevel portion of the semiconductor wafer W.

Figure 3B:
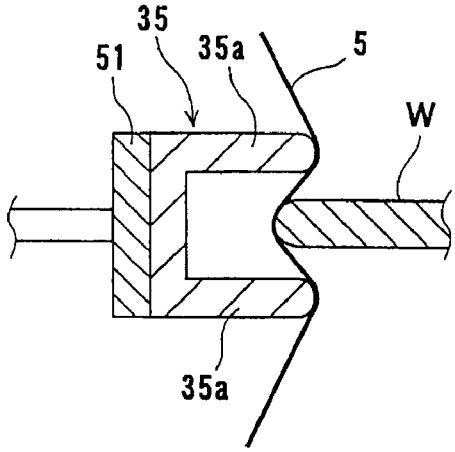
FIG. 3B is an enlarged cross-sectional view of another example of the polishing head shown in FIG. 3A.

FIG. 3B is an enlarged cross-sectional view of another example of the polishing head shown in FIG. 3A. As shown in FIG. 3B, the polishing head 35 has an ultrasonic vibrator 51 which applies mechanical vibration to the polishing head 35. With this structure, the polishing wastes attached to the polishing tape 5 can be removed, and the polishing tape 5 can be conditioned by the vibration and the polishing process is thus accelerated.

Figure 3C:
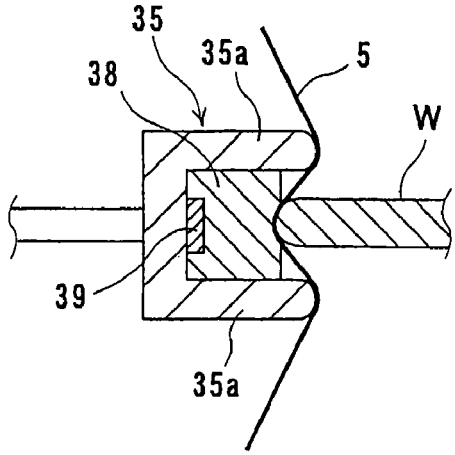
FIG. 3C is an enlarged cross-sectional view of still another example of the polishing head shown in FIG. 3A.

FIG. 3C is an enlarged cross-sectional view of still another example of the polishing head shown in FIG. 3A. As shown in FIG. 3C, the polishing head 35 has an elastic body (e.g., rubber) 38 interposed between the two projecting portions 35*a*, so that the polishing tape 5 is pressed against the bevel portion of the semiconductor wafer W by the elastic body 38. With this structure, it is possible to disperse the pressing force of the polishing tape 5 uniformly over the bevel portion. In this case, a pressing force measurement sensor 39 such as a load sensor may be provided behind the elastic body 38 so that the pressing force is controlled based on an output signal of the pressing force measurement sensor 39.

Here, the polishing tape 5 may be formed by a thin polishing film. Further, a polishing tape made of a material having a high flexibility may be used. Since a thin polishing film is used as a polishing tape, the polishing tape is not folded or bent on the surface of the semiconductor wafer W, particularly at a peripheral portion (the bevel portion and the edge portion). Therefore, the polishing tape 5 can reliably fit a curved shape of the peripheral portion of the semiconductor wafer W, and hence it is possible to uniformly polish the peripheral portion of the semiconductor wafer W. As a result, needle-like projections formed on the surface of the semiconductor wafer W or an unwanted film attached to the surface of the semiconductor wafer W can be removed uniformly and stably by polishing. Here, "a polishing tape" means a polishing tool in the form of a tape, and such a polishing tape includes a polishing film having a base film onto which polishing abrasive particles are applied, and a polishing cloth in the form of a tape.

As shown in FIG. 2, the pusher cylinder 36 is coupled to an oscillation mechanism 40 through a crank 37. The oscillation mechanism 40 comprises a pulley 40A fixed to a crankshaft 37*a* of the crank 37, a pulley 40B connected to the pulley 40A through a belt 40C, and a motor 40D coupled to the pulley 40B. The motor 40D is operable to rotate the pulley 40B in a normal direction and an opposite direction repetitively at a predetermined cycle. Therefore, the pusher cylinder 36 and the polishing head 35 are oscillated vertically by the oscillation mechanism 40 through the crank 37. In this embodiment, the crankshaft 37*a* extends in a tangential direction of the semiconductor wafer W on the rotational table 1, and hence the polishing head 35 is swung (pivoted or tilted) vertically about the bevel portion of the semiconductor wafer W. Therefore, the polishing tape 5 is brought into contact not only with the bevel portion but also with the edge portion of the semiconductor wafer W.

The above-mentioned oscillation mechanism 40 is connected to a relative movement mechanism 41 for moving the polishing head 35 relative to the semiconductor wafer W. This relative movement mechanism 41 reciprocates the oscillation mechanism 40 and the crank 37 along an extending direction of the crankshaft 37*a*. Therefore, the polishing head 35 connected to the crank 37 is reciprocated (oscillated) along the tangential direction of the semiconductor wafer W. In this manner, since the oscillation mechanism 40 is connected to the relative movement mechanism 41, the polishing head 35 is swung about the bevel portion of the semiconductor wafer W and is simultaneously reciprocated in the tangential direction of the semiconductor wafer W.

The oscillation mechanism 40 and the relative movement mechanism 41 are disposed outside the polishing chamber 2. An air cylinder is suitable for use as the relative movement mechanism 41. Here, the relative movement between the polishing head 35 and the semiconductor wafer W includes not only the reciprocating motion of the polishing head 35 but also the rotation of the semiconductor wafer W itself and the reciprocating motion of the rotational table 1 and the rotational drive mechanism as a whole in a direction parallel to the polishing surface of the polishing tape 5.

As shown in FIG. 1, a pure water ejector 45 for ejecting pure water into the polishing chamber 2 is disposed above the polishing head 35 and the rotational table 1. The pure water is supplied from the pure water ejector 45 to almost the entire polishing chamber 2, whereby the inner surface of the upper housing 3, the rotational table 1, the polishing head 35, and other equipment are cleaned by the pure water. The pure water, which has been supplied from the pure water ejector 45, is discharged to the exterior of the polishing chamber 2 through a liquid outlet pipe 46.

Figure 4A:
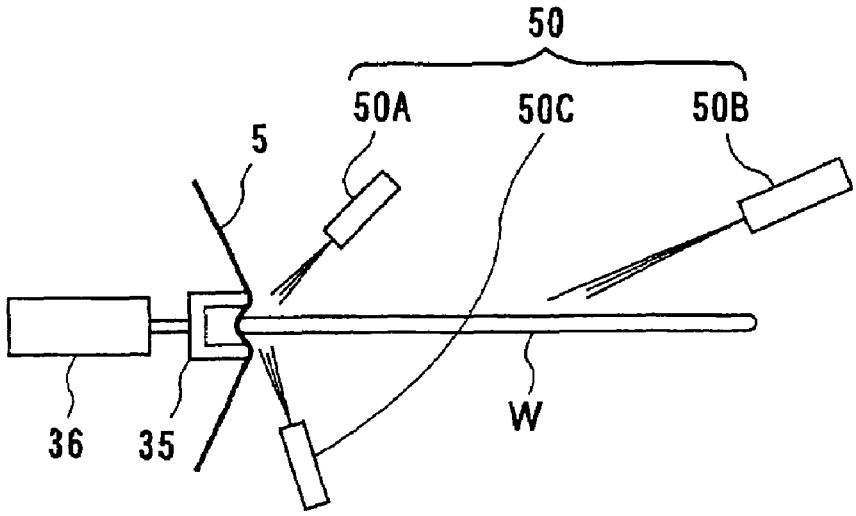
FIG. 4A is an enlarged view of a part of the polishing apparatus shown in FIG. 1.
Figure 4B:
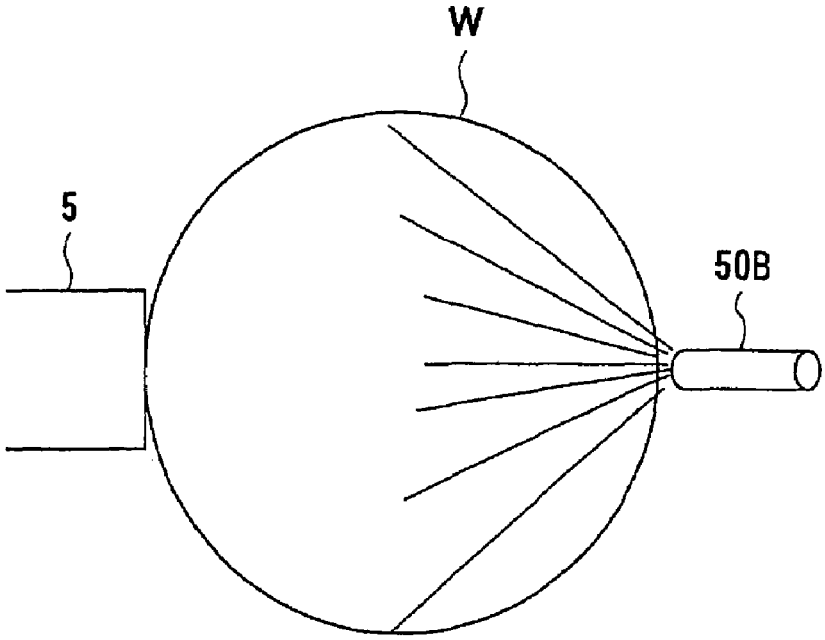
FIG. 4B is a plan view of the polishing apparatus shown in FIG. 4A.

FIG. 4A is an enlarged view of a part of the polishing apparatus shown in FIG. 1, and FIG. 4B is a plan view of the polishing apparatus shown in FIG. 4A.

As shown in FIG. 4A, the polishing apparatus comprises a liquid supply 50 for supplying a liquid to the semiconductor wafer W on the rotational table 1. Examples of the liquid to be supplied include pure water, a chemical liquid for accelerating the polishing, and a chemical liquid for lowering coefficient of friction. The liquid supply 50 comprises a first nozzle 50A for ejecting a liquid to a portion of contact between the polishing tape 5 and the semiconductor wafer W, a second nozzle 50B for ejecting a liquid to the front surface (upper surface) of the semiconductor wafer W, and a third nozzle 50C for ejecting a liquid to the peripheral portion at the rear-surface-side (lower-surface-side) of the semiconductor wafer W.

The first nozzle 50A ejects the liquid mainly to a portion, which is being polished, of the semiconductor wafer W and serves to cool such portion, lower the coefficient of friction, and wash out the polishing wastes quickly. As shown in FIG. 4B, the liquid ejected from the second nozzle 50B forms a triangular flow. In this state, when the semiconductor wafer W is rotated, the liquid spreads over the front surface of the semiconductor wafer W to form a liquid film covering the entire front surface of the semiconductor wafer W. Therefore, the front surface of the semiconductor wafer W is protected from an ambient atmosphere by the liquid film. The third nozzle 50C ejects the liquid to the rear surface (lower surface) of the semiconductor wafer W so as to prevent the polishing wastes from entering the rear-surface-side of the semiconductor wafer W and thus to prevent the polishing wastes from attaching to the rear surface of the semiconductor wafer W and the rotational table 1. The liquid supplied from the first nozzle 50A, the second nozzle 50B, and the third nozzle 50C is discharged to the exterior of the polishing chamber 2 through the liquid outlet pipe 46 (see FIG. 1).

Next, operation of the polishing apparatus of this embodiment will be described.

The air cylinder 31 is activated to lift the shutter 30, thereby opening the entrance aperture 3*a*. The semiconductor wafer W to be polished is transferred into the polishing chamber 2 through the entrance aperture 3*a* by the non-illustrated transfer robot. The semiconductor wafer W is transferred until it reaches a position right above the rotational table 1, and is then held by the arms 21 of the positioning mechanism 20. At this time, the positioning, i.e., the centering, of the semiconductor wafer W is performed. The arms 21 are lowered while holding the semiconductor wafer W and then place the semiconductor wafer W onto the upper surface of the rotational table 1. In this state, the vacuum source produces a vacuum in the through-hole 7*a* to thereby attract the semiconductor wafer W to the upper surface of the rotational table 1. The arms 21 are further lowered and then wait at a predetermined waiting position. Then, the motor 14 is energized to rotate the semiconductor wafer W together with the rotational table 1.

Thereafter, the motor 6C of the polishing tape supply mechanism 6 is driven to supply the polishing tape 5 into the polishing chamber 2 at a low speed. The polishing head 35 is moved by the pusher cylinder 36 toward the semiconductor wafer W, and the polishing surface of the polishing tape 5 is brought into contact with the bevel portion of the semiconductor wafer W by the polishing head 35, thereby polishing the semiconductor wafer W. At this time, the oscillation mechanism 40 and the relative movement mechanism 41 are driven so that the polishing head 35 oscillates vertically and is reciprocated in the tangential direction of the semiconductor wafer W. Accordingly, both the bevel portion and the edge portion of the semiconductor wafer W are polished simultaneously. Instead of reciprocating the polishing head 35, the rotational table 1 may be reciprocated in the extending direction of the crankshaft 37*a*.

During the polishing, the pressing force, which is produced by the tension of the polishing tape 5, is applied to the peripheral portion of the semiconductor wafer W. This pressing force is kept constant even when the portion of contact between the polishing tape 5 and the semiconductor wafer W is shifted from the bevel portion to the edge portion. Therefore, it is possible to achieve a constant polishing rate (removal rate) and a constant polishing profile at all times without depending on shape or dimensional variation of the semiconductor wafer W.

While the semiconductor wafer W is being polished, the liquid such as pure water is supplied from the first, second, and third nozzles 50A, 50B, and 50C to the semiconductor wafer W. By supplying the liquid, the semiconductor wafer W can be cooled and the coefficient of friction can be lowered. Further, since the exposed surface of the semiconductor wafer W is covered with the liquid, it is possible to prevent the scattered polishing wastes (powders) from attaching to the device part of the semiconductor wafer W. Furthermore, during the polishing, the vacuum source 13 evacuates the polishing chamber 2 through the gas outlet pipe 16 so that an internal pressure of the polishing chamber 2 (i.e., a pressure of a gas inside the polishing chamber 2) is lower than an external pressure of the polishing chamber 2 (i.e., a pressure of a gas outside the polishing chamber 2). Accordingly, the polishing wastes and the particles scattered in the polishing chamber 2 can be discharged to the exterior through the gas outlet pipe 16. Consequently, the polishing chamber 2 can be kept clean, and the polishing wastes are prevented from entering a region where a high cleanliness is required.

It is preferable to provide a pressure gradient as follows:

pressure in external space of the polishing apparatus>pressure in the polishing chamber 2>pressure in the equipment rooms 15A, 15B According to this embodiment, it is possible to prevent defects of the device part from occurring due to attachment of the polishing wastes and the particles. Further, according to this embodiment, since the polishing tape 5 is continuously supplied, a new polishing surface can be provided for the sliding contact with the peripheral portion of the semiconductor wafer W. Therefore, it is possible to obtain a uniform polishing rate and a uniform polishing profile over the entire peripheral portion of the semiconductor wafer W.

A polishing end point of this polishing apparatus may be managed based on a polishing time or may be managed by providing an end point detector. For example, a light source (e.g., leaser or LED) may be provided for applying a light having a certain shape and intense to a portion where the polishing head 35 is not located so that the polishing end point is detected based on irregularities of the bevel portion measured by detecting a scattered light from the semiconductor wafer W. In this example, the light is applied in a direction normal to the device part of the semiconductor wafer. Alternatively, temperature change of the peripheral portion of the semiconductor wafer may be monitored so that the polishing end point is detected based on the temperature change. Hereinafter, examples of the end point detector will be described with reference to the drawings.

Figure 5:
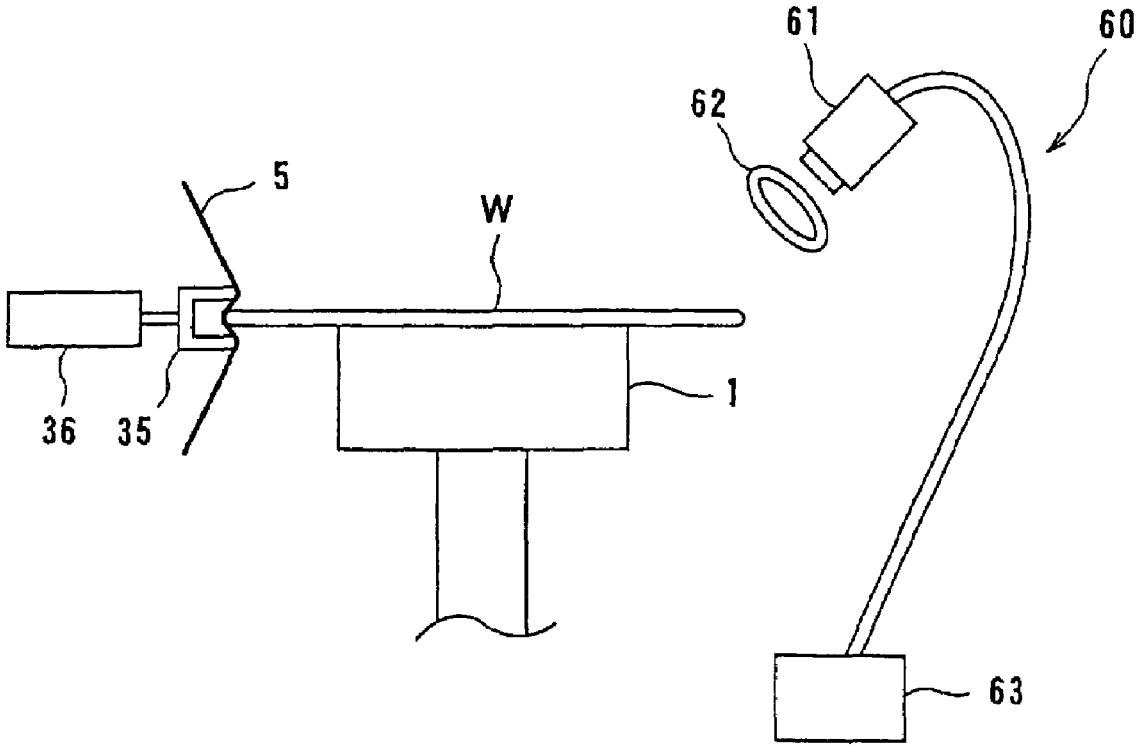
FIG. 5 is a side view showing an example of an end point detector for detecting a polishing end point.

FIG. 5 is a side view showing an example of an end point detector for detecting a polishing end point. As shown in FIG. 5, the end point detector 60 comprises an image sensor 61 such as a CCD camera, a ring illuminator 62 located between the image sensor 61 and the semiconductor wafer W to be detected, and a controller 63 for determining whether or not the polishing end point is reached based on an image obtained by the image sensor 61.

In this end point detector 60, the ring illuminator 62 illuminates the peripheral portion of the semiconductor wafer W during the polishing, and the image sensor 61 takes an image of the peripheral portion of the semiconductor wafer W. Then, the image obtained by the image sensor 61 is captured in the controller 63. The controller 63 observes color change of the peripheral portion of the semiconductor wafer W so as to determine the condition of the polished peripheral portion, and detects the polishing end point from the color change. The controller 63 sends an end point detection signal to a polishing control section (not shown) when detecting the polishing end point, whereby the polishing head 35 is moved to bring the polishing tape 5 out of contact with the peripheral portion of the semiconductor wafer W and then the rotation of the rotational table 1 is stopped.

An initial profile of the peripheral portion of the semiconductor wafer W may be stored in the controller 63 in advance through the image sensor 61 before starting the polishing process so that the peripheral portion of the semiconductor wafer W is polished so as to keep the initial profile. Factors, which determine the initial profile, include angle of inclination, curvature, and dimension of the peripheral portion of the semiconductor wafer W. Alternatively, as a reference image, an image of a peripheral portion of a finished semiconductor wafer, which has been polished, may be stored in the controller 63 in advance through the image sensor 61. In this case also, it is possible to detect the polishing end point by comparing the image, which is obtained by the image sensor 61 during the polishing, with the reference image.

Figure 6:
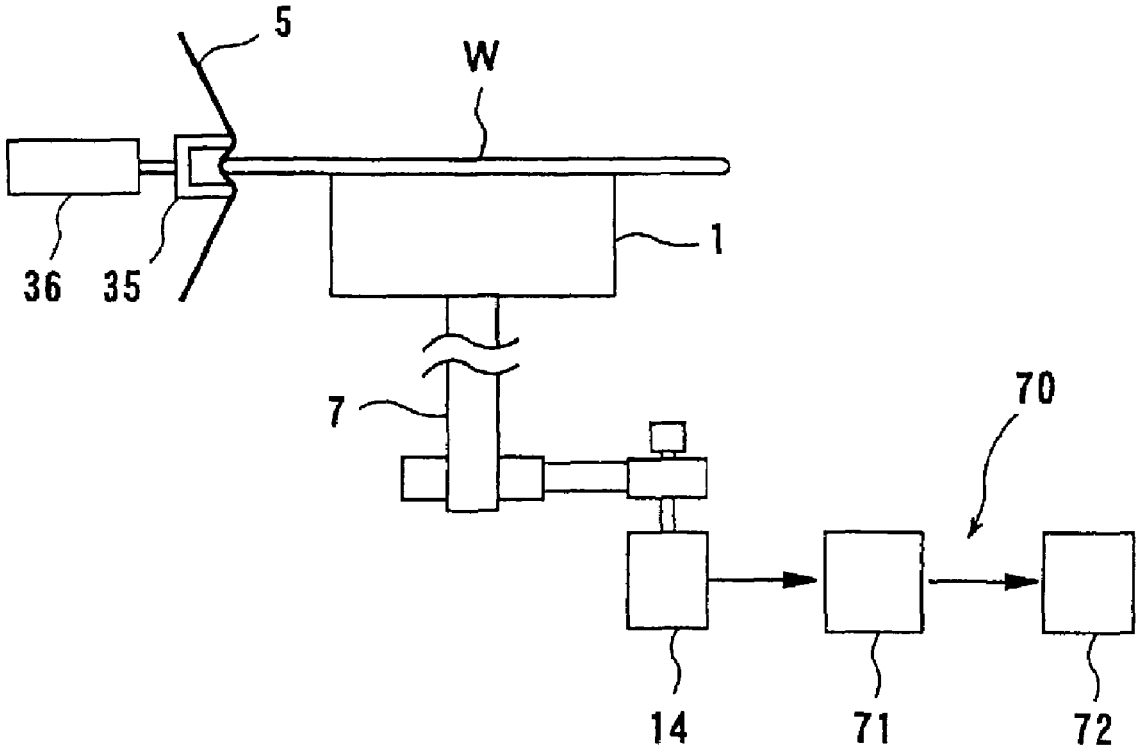
FIG. 6 is a side view showing another example of an end point detector for detecting a polishing end point.

FIG. 6 is a side view showing another example of an end point detector for detecting a polishing end point. As shown in FIG. 6, the end point detector 70 comprises an amplifier 71 connected to the motor (servomotor) 14 for rotating the rotational table 1, and a controller 72 for determining whether or not the polishing end point is reached based on a signal which has been amplified by the amplifier 71.

In this end point detector 70, while the peripheral portion of the semiconductor wafer W is being polished, the amplifier 71 amplifies a signal (e.g., current value) from the motor 14 which rotates the rotational table 1 at a predetermined speed, and sends the amplified signal to the controller 72. Based on the signal from amplifier 71, the controller 72 detects a torque required for the rotation of the motor 14, analyzes torque change, and detects the polishing end point. The controller 72 sends an end point detection signal to the polishing control section (not shown) when detecting the polishing end point, whereby the polishing head 35 is moved to bring the polishing tape 5 out of contact with the peripheral portion of the semiconductor wafer W and then the rotation of the rotational table 1 is stopped.

A torque gage may be provided on the rotational drive shaft 7 so as to directly measure the torque for rotating the rotational table 1. In this case also, it is possible to detect the polishing end point by analyzing the torque change. Alternatively, the polishing end point may be detected by analyzing pressure change of the relative movement mechanism 41 for reciprocating the polishing head 35, or by analyzing change of current value of a servomotor (not shown) which reciprocates the rotational table 1.

Figure 7A:
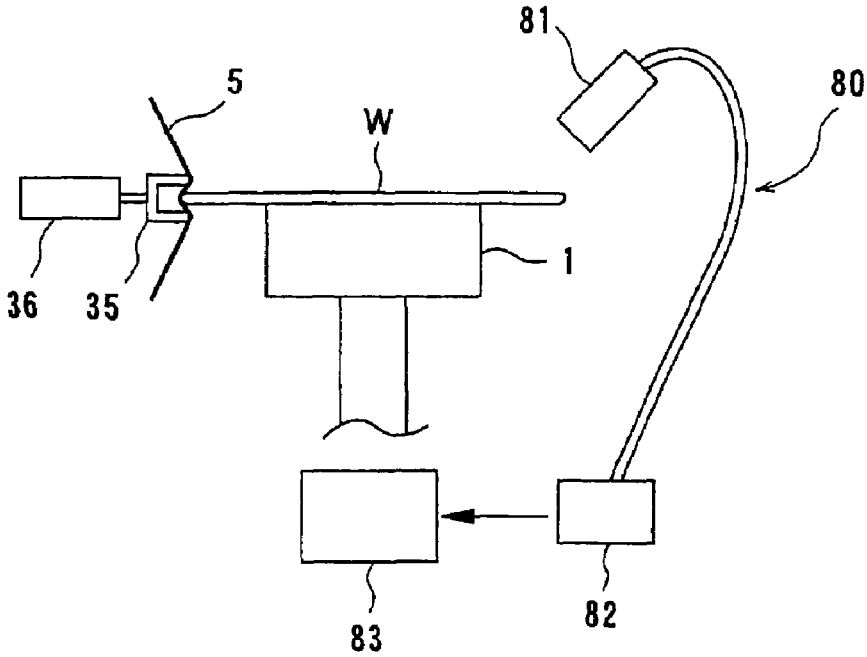
FIG. 7A is a side view showing still another example of a whole structure of an end point detector for detecting a polishing end point.
Figure 7B:
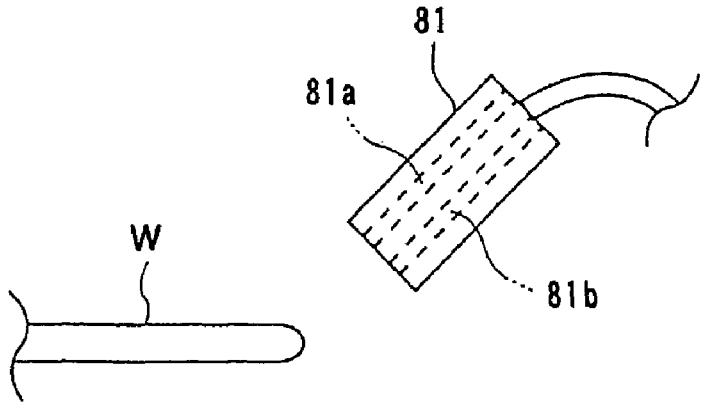
FIG. 7B is a schematic view of a photo sensor having a light emitting device and a light receiving device.

FIG. 7A is a side view showing still another example of a whole structure of an end point detector for detecting a polishing end point, and FIG. 7B is a schematic view of a photo sensor having a light emitting device and a light receiving device. As shown in FIGS. 7A and 7B, the end point detector 80 comprises a photo sensor 81 having a light emitting device 81*a* and a light receiving device 81*b*, a measurement amplifier 82 for measuring and amplifying a light received by the light receiving device 81*b* of the photo sensor 81, and a controller 83 for determining whether or not the polishing end point is reached based on a signal which has been amplified by the measurement amplifier 82.

In this end point detector 80, the light emitting device 81*a* of the photo sensor 81 emits the light to the peripheral portion of the semiconductor wafer W during the polishing of the peripheral portion, and the light receiving device 81*b* receives the scattered light from the peripheral portion of the semiconductor wafer W. Then, the measurement amplifier 82 measures the scattered light received by the light receiving device 81*b* and amplifies the signal, and sends the amplified signal to the controller 83. The controller 83 analyzes the scattered light based on the signal from the measurement amplifier 82 so as to evaluate the surface roughness of the polished peripheral portion of the semiconductor wafer W, thereby detecting the polishing end point.

In the polishing apparatus of this embodiment, since the polishing tape 5 is dragged in the rotational direction of the semiconductor wafer W attracted to the rotational table 1, a tension (i.e., tensile stress) is created in the polishing tape 5. Thus, by measuring this tension (i.e., tensile stress) using a strain gage or the like so as to analyze change of tension during the polishing, the polishing end point may be detected. In this case, the controller can detect the polishing end point by analyzing change of tension which is measured by the strain gage or the like.

Although the polishing apparatus described above is designed to polish the bevel portion and the edge portion of the semiconductor wafer W, the polishing apparatus may have a notch polishing mechanism for polishing a notch portion of the semiconductor wafer W. In this case, the polishing tape is brought into sliding contact with the notch portion of the semiconductor wafer W and pressed against the notch portion by a circular elastic member. The elastic member should preferably have a circumferential portion of a tapered shape corresponding to the shape of the notch portion.

Figure 8:
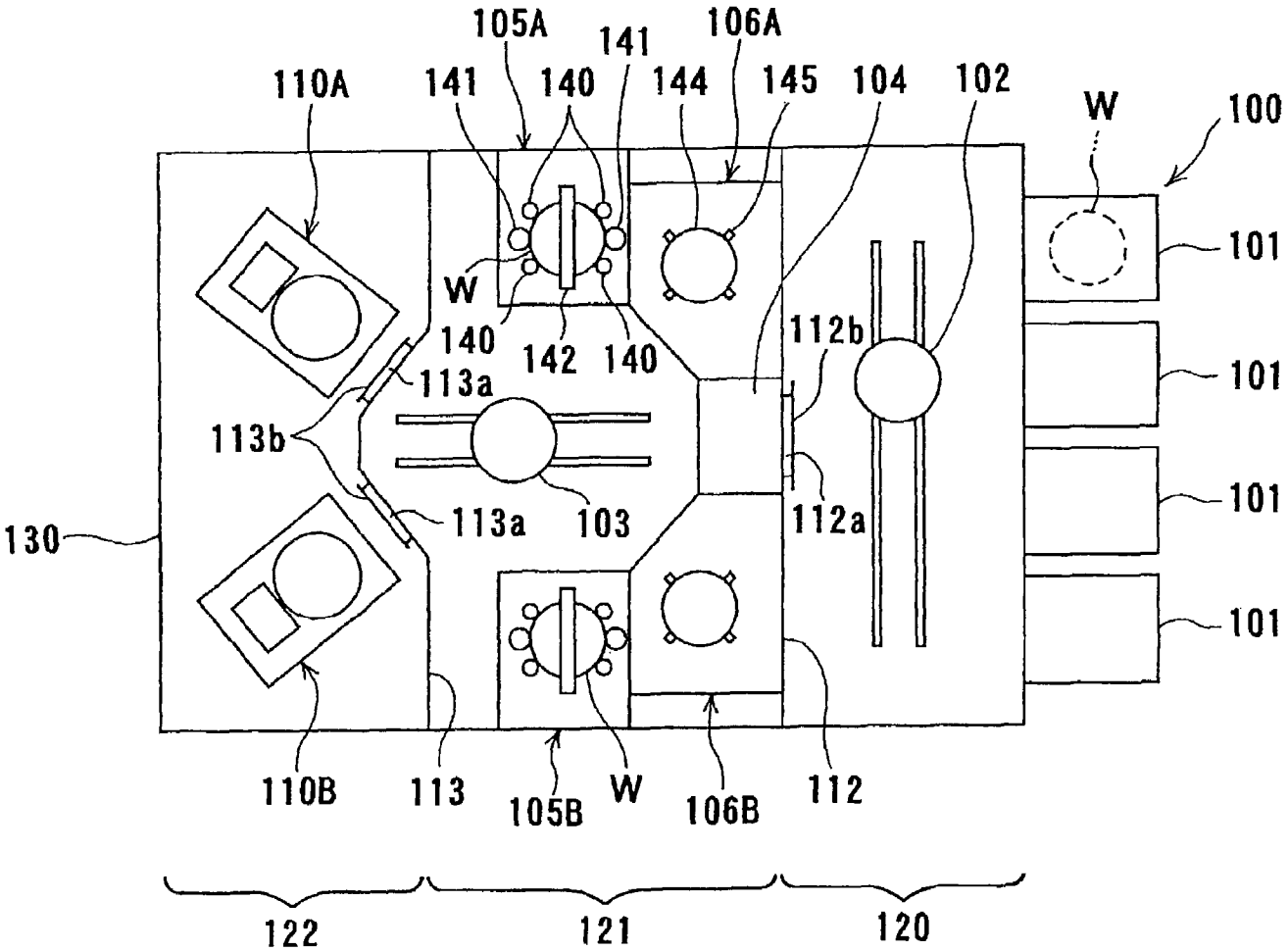
FIG. 8 is a plan view showing a whole structure of a substrate processing apparatus according to an embodiment of the present invention.
Figure 9:
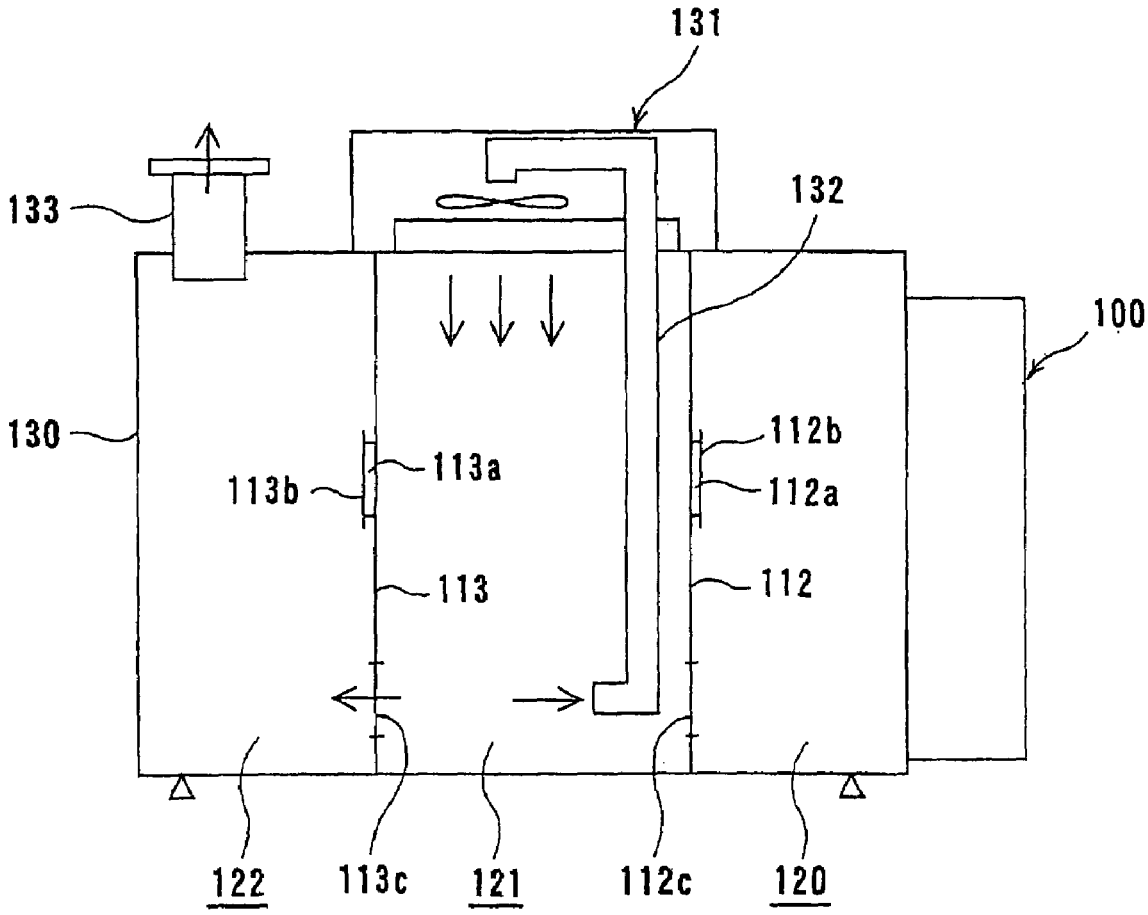
FIG. 9 is a side view of the substrate processing apparatus shown in FIG. 8.

Next, a substrate processing apparatus according to an embodiment of the present invention will be described with reference to FIGS. 8 and 9. FIG. 8 is a plan view showing a whole structure of a substrate processing apparatus according to an embodiment of the present invention, and FIG. 9 is a side view of the substrate processing apparatus shown in FIG. 8.

As shown in FIG. 8, the substrate processing apparatus comprises a load/unload stage 100 on which four wafer cassettes 101 accommodating a plurality of semiconductor wafers (substrates) are placed, a first transfer robot (a first transfer mechanism) 102 for transferring a dry semiconductor wafer, a second transfer robot (a second transfer mechanism) 103 for transferring a wet semiconductor wafer, a temporary loading stage 104 on which an unprocessed or a processed semiconductor wafer is placed, polishing units 110A, 110B for polishing a bevel portion and a notch portion of a semiconductor wafer, cleaning units 105A, 105B for cleaning the semiconductor wafer which has been polished, and rinsing-drying units 106A, 106B for rinsing and drying the semiconductor wafer which has been cleaned. The cleaning units 105A, 105B have the same structure, and the rinsing-drying units 106A, 106B have also the same structure. The first transfer robot 102 moves in parallel with an arrangement direction of the four wafer cassettes 101 on the load/unload stage 100 and removes a semiconductor wafer from one of the wafer cassettes 101.

Each of the polishing units 110A, 110B comprises a bevel polishing mechanism having the polishing head 35, the pusher cylinder 36, the polishing tape supply mechanism 6, which are illustrated in FIG. 1, and a non-illustrated notch polishing mechanism for polishing a notch portion of the semiconductor wafer by bringing a polishing tape into sliding contact with the notch portion. However, the notch polishing mechanism may not be provided, or the bevel polishing mechanism and the notch polishing mechanism may be provided separately in the polishing units 110A, 110B, respectively. The bevel polishing mechanism may comprise the oscillation mechanism 40 and the relative movement mechanism 41 illustrated in FIG. 2 so as to polish not only the bevel portion but also the edge portion of the semiconductor wafer simultaneously. Components of the polishing units 110A, 110B which will not be described below are identical to those of the polishing apparatus shown in FIG. 1.

The first transfer robot 102 serves to transfer the semiconductor wafer between the wafer cassette 101 on the load/unload stage 100 and the temporary loading stage 104. The second transfer robot 103 serves to transfer the semiconductor wafer among the temporary loading stage 104, the polishing units 110A, 110B, the cleaning units 105A, 105B, and the rinsing-drying units 106A, 106B. The second transfer robot 103 may have two hands: one is for holding a dirty semiconductor wafer which has been polished, and the other is for holding a clean semiconductor wafer which has been cleaned.

A first partition 112 is provided between the rinsing-drying units 106A, 106B and the first transfer robot 102, and a second partition 113 is provided between the cleaning units 105A, 105B and the polishing units 110A, 110B. By the first partition 112 and the second partition 113, the internal space of the substrate processing apparatus is divided into a transferring area 120, a cleaning area 121, and a polishing area 122.

The first partition 112 has a gate 112*a* and a shutter 112*b* for allowing the semiconductor wafer to be transferred between the first transfer robot 102 and the temporary stage 104. Further, the second partition 113 has gates 113*a* and shutters 113*b* for allowing the semiconductor wafer to be transferred between the second transfer robot 103 and the polishing units 110A, 110B. The second transfer robot 103 moves in parallel with an arrangement direction of the cleaning area 121 and the polishing area 122. The cleaning units 105A, 105B and the rinsing-drying units 106A, 106B are surrounded by non-illustrated partitions, respectively, each of which has a gate and a shutter for allowing the semiconductor wafer to be transferred by the second transfer robot 103.

As shown in FIG. 9, the substrate processing apparatus is surrounded by a partition wall 130. A fan unit 131 comprising an air supply fan and a filter, such as a chemical filter, a HEPA filter, or an ULPA filter, is provided on an upper portion of the partition wall 130 so that a clean air is supplied to the cleaning area 121 located below the fan unit 131. The fan unit 131 sucks an air from a lower portion of the cleaning area 121 and supplies the clean air, which has passed through the above filter, downwardly. In this manner, a downward current of the cleaning air toward the surface of the semiconductor wafer is formed in the cleaning area 121, thereby preventing contamination of the semiconductor wafer during the cleaning and the transferring of the semiconductor wafer. The clean air supplied from the fan unit 131 is introduced into the polishing area 122 through a vent hole 113*c* formed in the second partition 113. The air, which has been supplied to the polishing area 122, is discharged to the exterior through a discharge hole 133. The first partition 112 has a vent hole 112*c* through which the clean air is introduced from the transferring area 120 into the cleaning area 121.

The pressure gradient is set as follows: a pressure in the transferring area 120>a pressure in the cleaning area 121>a pressure in the polishing area 122. With such pressure gradient, the substrate processing apparatus can serve as a peripheral portion polishing apparatus of dry-in dry-out type which can perform a very clean process not only when it is installed in a clean room, but also when installed under the ordinary circumstance with no dust management.

Next, steps of process performed by the substrate processing apparatus having the above structure will be described.

The wafer cassettes 101 accommodating semiconductor wafers, which have been subjected to CMP process or Cu forming process, are transferred to the substrate processing apparatus by a non-illustrated cassette transfer device, and are placed on the load/unload stage 100. The first transfer robot 102 removes the semiconductor wafer from the wafer cassettes 101 on the load/unload stage 100, and places the semiconductor wafer onto the temporary loading stage 104. The second transfer robot 103 transfers the semiconductor wafer on the temporary loading stage 104 to the polishing unit 110A (or 110B). Then, the polishing of the notch portion and/or the bevel portion is performed in the polishing unit 110A.

In this polishing unit 110A, during or after the polishing, pure water or a chemical liquid is supplied from the liquid supply 50 (see FIGS. 4A and 4B), which is disposed near the semiconductor wafer, to the upper surface, the peripheral portion, and the lower surface of the semiconductor wafer. Accordingly, the semiconductor wafer is cooled and coefficient of friction is lowered. Further, a liquid film is formed on the surface of the semiconductor wafer, thereby preventing the polishing wastes and particles from attaching to the surface of the semiconductor wafer. The supply of the liquid is performed not only for the above purpose but also for the purpose of maintenance of a material on the surface of the semiconductor wafer in the polishing unit 110A (for example, to form a uniform oxide film while avoiding changes in properties, such as non-uniform oxidation of the wafer surface due to a chemical liquid or the like).

The semiconductor wafer which has been polished is transferred from the polishing unit 110A to the cleaning unit 105A (or 105B) by the second transfer robot 103. In this cleaning unit 105A, the polished semiconductor wafer is held and rotated by four rotatable rollers 140, at least one of which is rotated by a drive source (not shown). While the semiconductor wafer is being rotated, pure water is supplied from a pure water nozzle (not shown) to the semiconductor wafer and roller sponges 141 having a truncated cone shape are brought into contact with the peripheral portion of the semiconductor wafer to perform a scrub cleaning. Further, in the cleaning unit 105A, cylindrical roller sponges 142 are moved to positions above and below the semiconductor wafer and brought into contact with the upper and lower surfaces of the semiconductor wafer, respectively. In this state, pure water is supplied to the semiconductor wafer from pure water supply nozzles (not shown), which are disposed above and below the semiconductor wafer, and the roller sponges 142 are rotated to thereby scrub the entire upper and lower surfaces of the semiconductor wafer.

The semiconductor wafer, which has been scrubbed, is transferred from the cleaning unit 105A to the rinsing-drying unit 106A (or 106B) by the second transfer robot 103. In this rinsing-drying unit 106A, the semiconductor wafer is placed on a rotational stage 144 and held by a spin chuck 145. Then, the semiconductor wafer is rotated at a low speed of 100 to 500 $min^{-1}$ and pure water is supplied onto the entire surface of the semiconductor wafer to rinse it. Thereafter, the supply of the pure water is stopped, and the semiconductor wafer is rotated at a high speed of 1500 to 5000 $min^{-1}$. At this time, a clean inert gas may be supplied to the semiconductor wafer if necessary. In this manner, spin dry of the semiconductor wafer is performed.

The semiconductor wafer, which has been dried by the rinsing-drying unit 106A, is then transferred to the temporary loading stage 104 by the second transfer robot 103. Further, the semiconductor wafer placed on the temporary loading stage 104 is transferred to the wafer cassette 101 on the load/unload stage 100 through the gate 112*a* by the first transfer robot 102. Alternatively, the semiconductor wafer may be transferred directly from the rinsing-drying unit 106A (or 106B) to the wafer cassette 101 through a gate (not shown) by the first transfer robot 102. In the cleaning units 105A, 105B and the rinsing-drying units 106A, 106B, contact-type cleaning (e.g., cleaning with a PVA sponge in the form of a pencil or a roll) and non-contact-type cleaning (e.g., cleaning with a cavitation jet or a liquid to which supersonic wave is applied) may be combined as needed.

In the above-mentioned process, the bevel portion and/or the notch portion of the semiconductor wafer are polished in the polishing unit 110A and the semiconductor wafer is cleaned and dried in the cleaning unit 105A and the rinsing-drying unit 106A. In this case, two semiconductor wafers can be processed simultaneously in two processing lines, one of which comprises the polishing unit 110A, the cleaning unit 105A, and the rinsing-drying unit 106A, and the other comprises the polishing unit 110B, the cleaning unit 105B, and the rinsing-drying unit 106B. In this manner, two semiconductor wafers can be processed in parallel in the two processing lines, and hence processing performance (throughput) can be improved.

After the notch portion is polished in the polishing unit 110A, the semiconductor wafer may be transferred to the polishing unit 110B so that the bevel portion is polished in the polishing unit 110B. Alternatively, the bevel portion and the notch portion may be polished roughly in the polishing unit 110A, and then finish-polishing may be performed in the polishing unit 110B. In this manner, the polishing unit 110A and the polishing unit 110B may be used separately so as to perform serial process.

Figure 10:
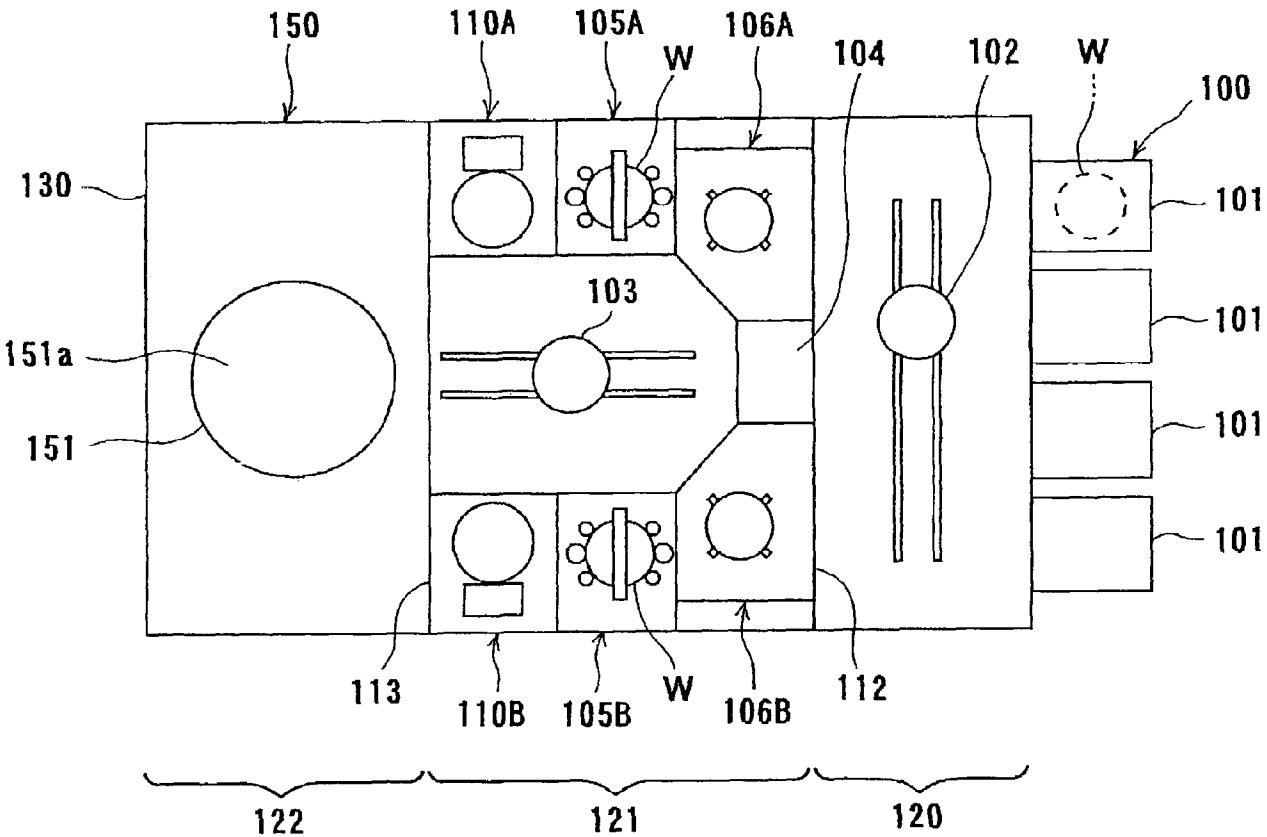
FIG. 10 is a plan view showing a whole structure of a substrate processing apparatus according to another embodiment of the present invention.
Figure 11:
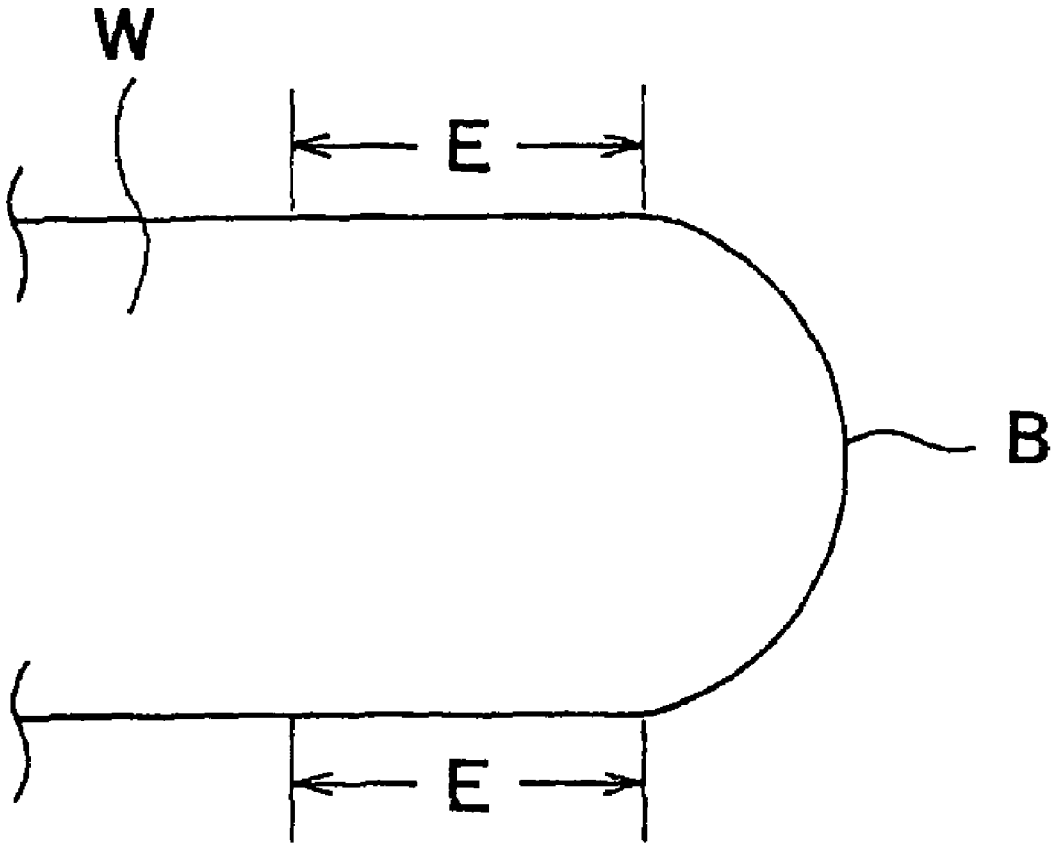
FIG. 11 is a view illustrating a bevel portion and an edge portion of a semiconductor wafer.

Next, a substrate processing apparatus according to another embodiment of the present invention will be described with reference to FIG. 10. FIG. 10 is a plan view showing a whole structure of a substrate processing apparatus according to another embodiment of the present invention. The substrate processing apparatus of this embodiment comprises the polishing apparatus illustrated in FIGS. 1 and 2 as the polishing units 110A, 110B. Components and operation of this embodiment, which will not be described below, are identical to those of the substrate processing apparatus shown in FIGS. 8 and 9, and will not be described repetitively.

As shown in FIG. 10, the substrate processing apparatus of this embodiment is different from the substrate processing apparatus shown in FIG. 8 in that a CMP (Chemical Mechanical Polishing) unit 150 is provided in the polishing area 122 and the polishing units 110A, 110B are provided in the cleaning area 121. In this embodiment also, the internal space of the substrate processing apparatus is divided into the transferring area 120, the cleaning area 121, and the polishing area 122 by the first partition 112 and the second partition 113 each having the gate and the shutter, and pressures in these areas are set as follows: The transferring area 120>the cleaning area 121>the polishing area 122. The CMP unit 150 shown in FIG. 10 is provided to polish the surface of the semiconductor wafer. In this CMP unit 150, the semiconductor wafer is pressed against a polishing surface 151*a* provided on a polishing table 151 by a non-illustrated polishing head while a polishing liquid is being supplied onto the polishing surface 151*a*.

Next, steps of process performed by the substrate processing apparatus of this embodiment will be described. A semiconductor wafer to be polished is transferred from the wafer cassette 101 on the load/unload stage 100 to the temporary loading stage 104 by the first transfer robot 102, and then transferred from the temporary loading stage 104 to the CMP unit 150 by the second transfer robot 103. In the CMP unit 150, the surface of the semiconductor wafer is polished chemically and mechanically. The semiconductor wafer, which has been polished by the CMP unit 150, is transferred to the polishing unit 110A (or 110B), the cleaning unit 105A (or 105B), the rinsing-drying unit 106A (or 106B), and the temporary loading stage 104 in this order by the second transfer robot 103, so that the semiconductor wafer is successively processed in the respective units. Then, the processed semiconductor wafer is transferred from the temporary loading stage 104, or directly from the rinsing-drying unit 106A (or 106B), to the wafer cassette 101 on the load/unload stage 100.

Sequence of the process of the semiconductor wafer can be modified as desired. For example, the semiconductor wafer may be transferred to the temporary loading stage 104, the polishing unit 110A (or 110B), the CMP unit 150, the cleaning unit 105A (or 105B), the rinsing-drying unit 106A (or 106B), and the temporary loading stage 104 in this order. Alternatively, the semiconductor wafer may be transferred to the temporary loading stage 104, the polishing unit 110A, the CMP unit 150, the polishing unit 110B, the cleaning unit 105A (or 105B), the rinsing-drying unit 106A (or 106B), and the temporary loading stage 104 in this order. Furthermore, two CMP units may be provided for performing parallel processing and serial processing using two processing lines.

The present invention is applicable to a polishing apparatus for removing surface roughness produced at a peripheral portion (a bevel portion and an edge portion) of a substrate such as a semiconductor wafer, or for removing a film formed on a peripheral portion of a substrate, and to a substrate processing apparatus having such a polishing apparatus.

The invention claimed is:

1. A substrate processing apparatus comprising:

a polishing unit including a polishing tape, said polishing unit configured to polish a bevel portion of a substrate by bringing said polishing tape into sliding contact with the bevel portion of the substrate;

a cleaning unit configured to clean at least the bevel portion of the substrate;

a drying unit configured to dry the substrate which has been cleaned by said cleaning unit;

a transfer robot configured to transfer the dried substrate to a wafer cassette;

a first partition dividing an internal space of said substrate processing apparatus into a transferring area in which said transfer robot is disposed and a cleaning area in which said cleaning unit and said drying unit are disposed; and a second partition dividing the internal space of said substrate processing apparatus into said cleaning area and a polishing area in which said polishing unit is disposed, wherein an internal pressure of said polishing area is set to be lower than an internal pressure of said cleaning area, and an internal pressure of said transferring area is set to be higher than the internal pressure of said cleaning area.

2. A substrate processing apparatus according to claim 1, wherein said polishing unit brings said polishing tape into sliding contact with the bevel portion and an edge portion of the substrate so as to polish the bevel portion and the edge portion.

3. A substrate processing apparatus according to claim 1, wherein said polishing unit brings said polishing tape into sliding contact with a notch portion of the substrate so as to polish the notch portion.

4. A substrate processing apparatus according to claim 1, further comprising a fan unit configured to form a downward current of a clean gas in said cleaning area.

5. A substrate processing apparatus according to claim 1, further comprising a chemical mechanical polishing unit configured to polish a surface of the substrate by pressing the substrate against a polishing table, said chemical mechanical polishing unit being disposed in said polishing area.

* * * * *